United States Patent [19]

Nicholas

[11] Patent Number: 4,669,642

[45] Date of Patent: Jun. 2, 1987

[54] FOLDABLE SHIRT HANGER WITH REINFORCED COLLAR

[76] Inventor: Robert J. L. Nicholas, 7620 16th Ave., Richfield, Minn. 55423

[21] Appl. No.: 827,632

[22] Filed: Feb. 10, 1986

[51] Int. Cl.[4] ..... A47G 25/40

[52] U.S. Cl. ..... 223/94; 223/DIG. 4; 211/118

[58] Field of Search ..... 223/DIG. 4, 94, 89, 223/90; 211/117, 118, 119

[56] References Cited

U.S. PATENT DOCUMENTS

| | | | |
|---|---|---|---|
| 2,629,525 | 2/1953 | Peterson | 223/94 |
| 2,754,038 | 7/1956 | Varker | 223/94 |
| 2,881,965 | 4/1959 | Fetko | 223/94 |
| 3,856,190 | 12/1974 | Mole et al. | 223/94 |
| 4,300,688 | 11/1981 | London | 223/94 |

FOREIGN PATENT DOCUMENTS

| | | | |
|---|---|---|---|
| 624950 | 7/1927 | France | 223/94 |

*Primary Examiner*—Henry S. Jaudon
*Assistant Examiner*—Andrew M. Falik
*Attorney, Agent, or Firm*—Schroeder & Siegfried

[57] ABSTRACT

A foldable shirt hanger includes a frame having a bottom portion foldable to the rear upon itself with the shirt. Wings are secured to the lateral uppermost part of the frame for folding the arms of the shirt. A collar element is secured to a stem extending from a hook element to support the shirt collar, whether hanging from a support or being packed for shipment. The collar element pivots about a pair of pins to either lie flat against the shirt frame or be tilted away from it.

8 Claims, 9 Drawing Figures

FOLDABLE SHIRT HANGER WITH REINFORCED COLLAR

DESCRIPTION

This application relates to foldable hangers and more particularly to a foldable shirt hanger with reinforced collar.

BACKGROUND OF THE INVENTION

It has generally been known that certain hangers of foldable cardboard forms are useful when packing clothing to be placed in a suitcase. However, these forms which are generally made of cardboard are usually destroyed after the initial use or are not usable for reuse because of their flimsy construction. While the cardboard form serves a useful purpose, it does have its limitations and something that is reusable is more desirable.

FIELD OF THE INVENTION

It has been found that a form or hanger that is capable of being folded and reusable is not only useful in hanging shirts from a hanger but when the upper hook element is recessed, it may be used to fold the shirt in a convenient package for packing. The present invention is directed to a shirt form made of a plastic material having hinge areas at the location of wings that attach where the arms are sewn into the shirt and also has a transverse axis so that the lower portion of the form may be folded upwardly for more convenient packing. The collar device is generally set for the proper size and will be secured to the shirt form that may be pivoted when a shirt is being folded for placement in a suitcase.

It is therefore a general object of this invention to provide a foldable frame with a reinforcing collar element to be used with a shirt that is to be packed in luggage or a wardrobe.

It is yet another object of this invention to provide an improved frame to be used with a detachable collar element.

It is still a further object of this invention to provide a releasable hook element for engaging the shirt frame so that it may be hung.

It is another object of this invention to provide a collar element that flexes into a usable position.

BRIEF DESCRIPTION OF THE DRAWINGS

A detailed description of one preferred embodiment of the FOLDABLE SHIRT HANGER is hereafter described with specific reference being made to the drawings in which.

DETAILED DESCRIPTION OF THE INVENTION

Figure 2:
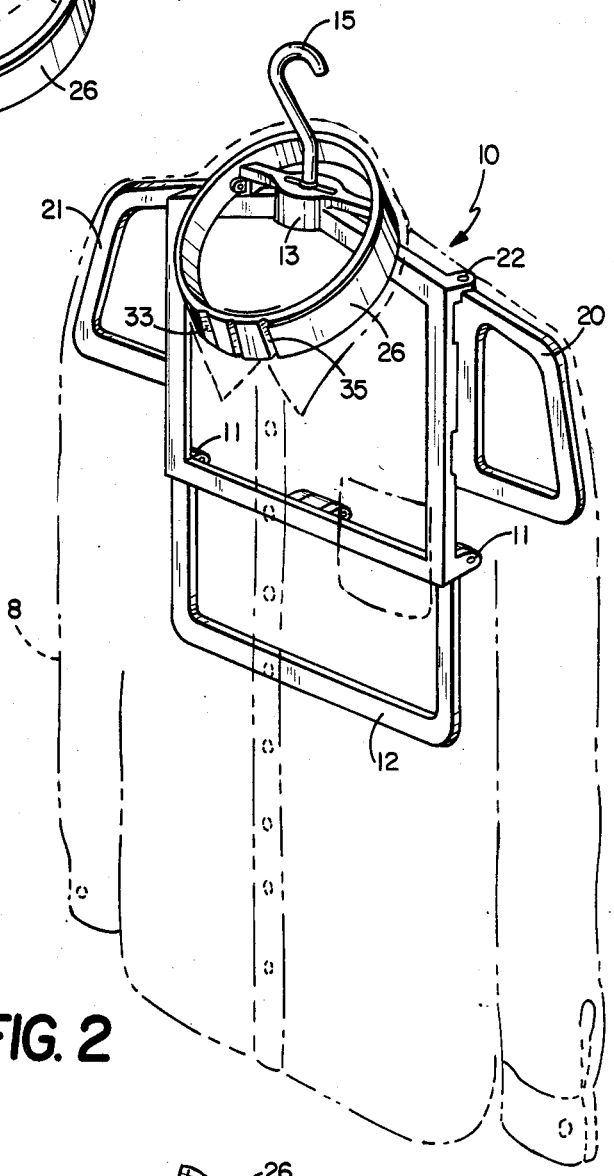
FIG. 2 is a perspective view of my invention with a shirt draped over the frame.
Figure 7:
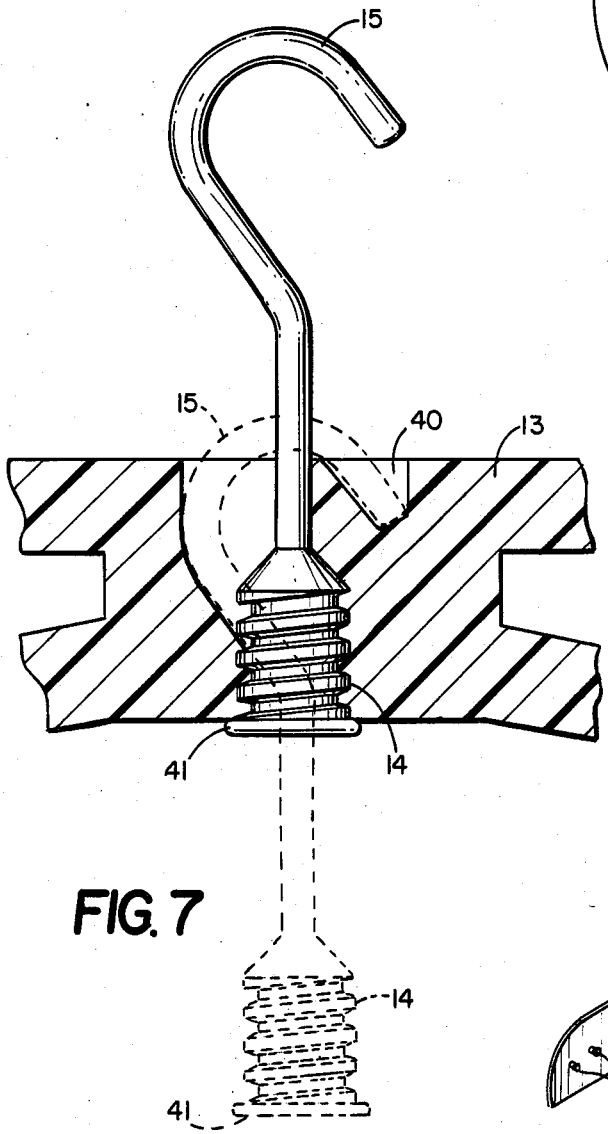
FIG. 7 is a sectional view of the frame hanger.

An open two-piece shirt body frame 10 is formed of plastic material and may be made of a cellular plastic material. The shirt frame 10 is formed primarily in the shape of a flattened shirt body in which there is a tail panel hinge line 11 formed in the middle third of the shirt body frame. That is, the hinge line is aligned in the material and the tail panel 12. Disposed at the top central portion of the shirt frame 10 is an oblong cross-sectional-shaped stem element 13 in the nature of an element having a cross-section of a large pitch screw thread like that of an Acme thread 14. A stem hook element 15 is formed to engage Acme thread 14 that is formed in the central portion thereof and extends longitudinally therewith. Thus, a shirt 8 may be secured over the frame 10 for hanging and may be packed when folded as seen in FIG. 2. That is hook element 15 may be extended to its lowest position as found in FIG. 7 where it fits into a recess 40. When Acme thread 14 is turned in the other direction, its travel is limited by a cap 41.

Figure 8:
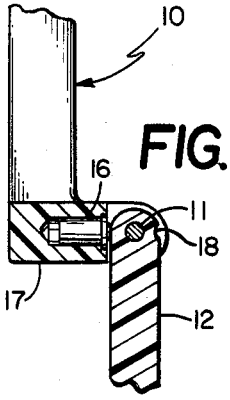
FIG. 8 is a second sectional view of the frame hanger.

To insure that tail panel 12 (FIG. 8) will remain in its vertical upright position when tilted there, a mechanical detent 16 is secured within a transverse section 17 extending at right angles toward hinge pin 11. Upon tail panel 12 being pivoted upwardly, the plunger in the detent encounters a recess 18 formed in tail panel 12 and it remains secured in that position until returned to the position found in FIG. 2.

Figure 1:
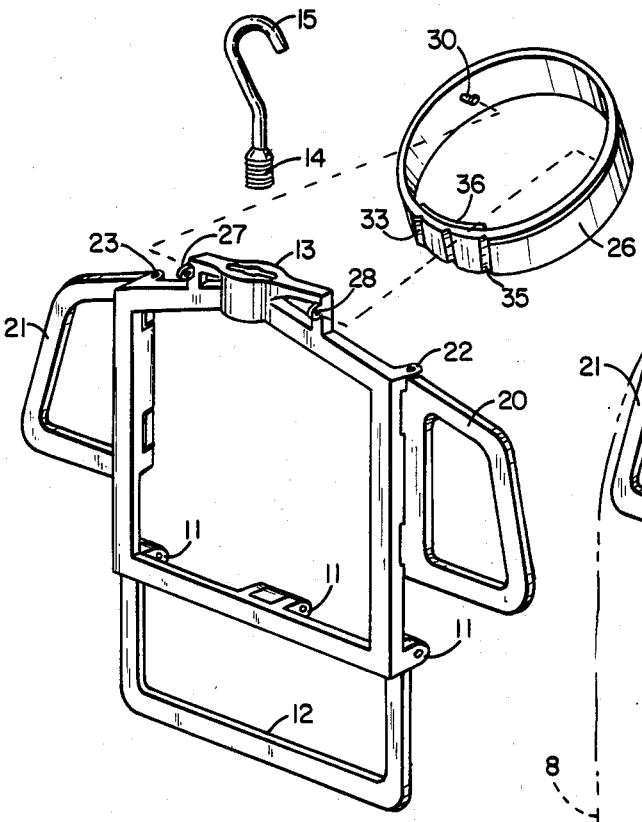
FIG. 1 is a perspective view of an embodiment of my invention.

The upper part of the shirt body frame has a pair of wing forms 20 and 21 hingedly secured thereto through the use of a plurality of pins 22 and 23 that slip through bores 24 and 25 formed in shirt body frame 10 and wing forms 20 and 21. The hinge elements consisting of pins and bores can be aligned in a vertical column along the shirt body frame as shown in FIG. 1. Wing forms 20 and 21 are formed so that they may be pivoted behind the shirt body frame 10. That is, the shirt may be secured about the body frame and the wing forms 20 and 21 pivoted behind the shirt form to fold the shirt.

It is desirable to have a detachable collar element 26 secured to the shirt frame 10 and this is accomplished through the use of a pair of forwardly extending upper portions 27 and 28 of shirt frame 10. The extensions 27 and 28 are tipped forwardly so that collar element 26 may be pivoted so that the shirt collar is protected. This is accomplished through the use of a pair of transverse pins 30 and 31 secured to collar 26 having enlarged tips formed on the ends thereof that extend through a pair of bores formed in extensions 27 and 28. The collar element 26 is collapsible through the use of additional fold lines formed vertically in the collar 26.

To insure that collar element 26 may be properly fitted into a shirt collar, two outside vertical fold lines, 33 and 35 are scored on the front of collar element 26'. A third fold line 34 is scored in between scores 33 and 35 on the front of collar element 26. A bendable securing element formed by semi-flexible strip 36 is secured to collar strip 26 by suitable means such as cementing or stitching and is contained near the center fold line 34 through the use of a stop pin 37. Pin 37 has an enlarged head that secures the semi-flexible strip 36 to the front portion of the collar, thus reinforcing it and stiffening the same.

Figure 3:
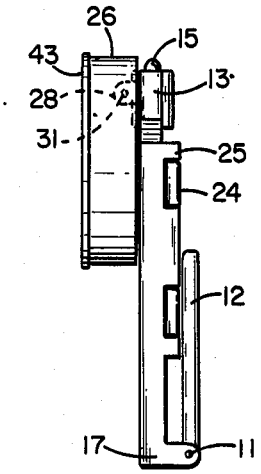
FIG. 3 is a side elevation view of my invention with the wings and tail portions folded on the frame.
Figure 4:
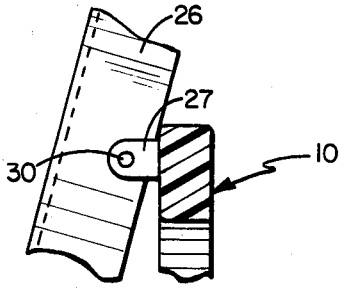
FIG. 4 is a section view of the collar of my invention.
Figure 5:
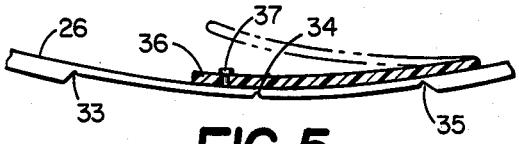
FIG. 5 is a section view of the collar of my invention showing its relative position on the shirt frame.
Figure 6:
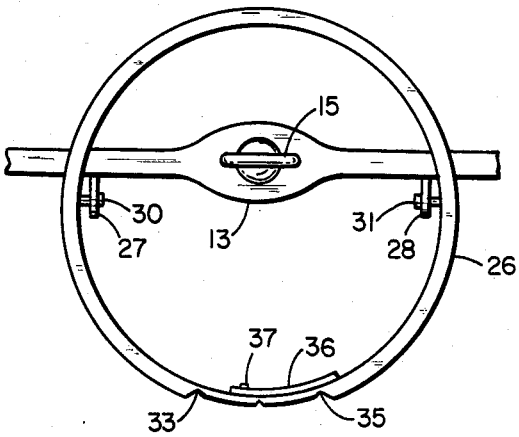
FIG. 6 is a plan view of the collar secured to the shirt frame.
Figure 9:
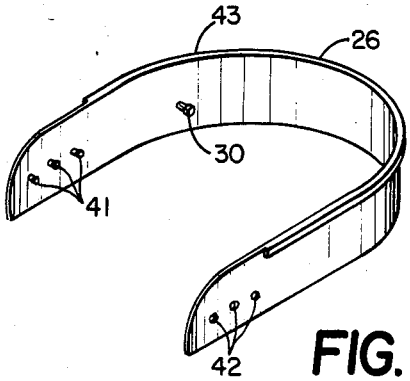
FIG. 9 is a perspective view of an alternate detachable collar in an open condition.

An alternate version of the collar 26 is found in FIG. 9 wherein a plurality of pins 41 are formed at the front of the collar that mate with a plurality of bores 42 to set the collar 26 for the correct size. When this version is used the collar has a fixed size, but will be collapsed like that shown in FIGS. 1 through 3.

With the shirt folded and the collar element in place, the shirt should be ready for packing in luggage or within a drawer.

In some versions, it may be helpful to eliminate the rim 43 that is formed on the upper edge of collar 26. The part to be eliminated appears much like a circumferential strip and will serve to reduce the size.

In considering this invention, it should be remembered that the present disclosure is illustrative only and the scope of the invention should be determined by the appended claims.

What is claimed is:

1. An improved foldable shirt hanger for use in packing a shirt, comprising;

(a) an open two piece foldable shirt body frame constructed and arranged to fit within a shirt and having a stem portion secured to an upper central portion thereof for engaging a hook element;

(b) a pair of wing forms hingedly secured to the two uppermost lateral edges of said shirt body frame for swinging behind said shirt body frame, said wing forms constructed and arranged to fit in the upper portion of the sleeves of a shirt;

(c) a retractable hook element constructed and arranged to move in a first direction to a first position and engage said stem for hanging said shirt body frame from a support and to retract said hook element within said stem portion upon further movement in a second direction when packing said shirt body frame in a second position; and (d) a single piece detachable collar element having securing means formed on the inside of said collar element to communicate with said stem portion and pivotally secure the same to said stem portion.

2. The structure as set forth in claim 1 which includes:

(e) a plurality of releasable holding elements formed at the ends of said collar element for joining the same at a proper collar size.

3. An improved foldable shirt hanger with reinforced collar for use in packing a shirt, comprising:

(a) an open two piece foldable shirt body frame having a front, back, and sides and constructed and arranged to fit within a shirt and having a stem secured to the upper central portion thereof for engaging a retractable hook element, the upper portion of said frame extending upwardly and terminating in a pair of bores formed therein, and a pair of extensions extending from the front of the upper central portion of said shirt body frame;

(b) a pair of wing forms hingedly secured to the two uppermost lateral edges of said shirt body frame for swinging behind said shirt body frame, said wing forms constructed and arranged to fit in the upper portion of the sleeves of a shirt;

(c) a movable hook element constructed and arranged to engage said stem in a first position for hanging said shirt body frame from a support and to retract said stem from said shirt body frame in a second position for packing said shirt body frame;

(d) a pair of releasably engagable pin elements extending transversely through said two piece foldable shirt body frame permitting pivotal movement upwardly;

(e) and a detachable collar element adapted to fit within the collar of a shirt having a pair of pins formed at the sides thereof for engaging the bores of said upper portion of the frame, said collar element including an elongated strip with a bendable securing element secured to each end thereof for collapsing said collar element.

4. The structure as set forth in claim 3 including:

(f) three spatially disposed vertical fold lines scored at the front of said detachable collar element;

(g) wherein said bendable securing element comprises a semi-flexible strip secured and biased to said collar on the inside it at or about one of said outside vertical fold lines and extending over said middle fold line, said semi-flexible strip forcing said collar outwardly into a circle and having a hole formed on or adjacent to said middle fold line;

(h) and a stop pin secured to said collar and extending inwardly to engage the hole in said semi-flexible strip to strengthen said single elongated strip.

5. The structure as set forth in claim 4 including:

(i) a plurality of hinge elements in vertical columns engaging said pair of wing forms and said shirt body frame.

6. The structure as set forth in claim 5 wherein said stem engaging portion is formed in the shape of a large pitch screw thread and said shirt body frame has a recess formed along the top thereof to accept the hook element when in the packing retractable position.

7. The structure as set forth in claim 3 wherein said upper portion of said frame engages said detachable collar element and permits swinging it between a first position against said shirt frame and a second position tilted away from said shirt frame.

8. The structure as set forth in claim 3 including:

(j) an open two piece foldable shirt body frame comprising a tail panel frame hingedly secured to said shirt body frame at its lowermost position;

(k) a detent secured in either said tail panel frame or said shirt body frame and extending toward said other frame; and (l) a recess formed in the other of said frames to cooperate with said detent and secure said tail panel frame against movement with respect to said shirt body frame.

* * * * *